US005368159A

United States Patent [19]

Doria

[11] Patent Number: 5,368,159

[45] Date of Patent: Nov. 29, 1994

[54] PROTECTION CASE FOR REMOTE CONTROLS

[75] Inventor: Alessandro Doria, Milan, Italy

[73] Assignee: Daniels s.r.l., Milan, Italy

[21] Appl. No.: 910,154

[22] PCT Filed: Jun. 15, 1992

[86] PCT No.: PCT/EP92/01350

§ 371 Date: Jul. 20, 1992

§ 102(e) Date: Jul. 20, 1992

[87] PCT Pub. No.: WO92/22918

PCT Pub. Date: Dec. 23, 1992

[30] Foreign Application Priority Data

Jun. 14, 1991 [IT] Italy ..... MI91A001640
Sep. 23, 1991 [WO] WIPO ..... PCT/EP91/01813

[51] Int. Cl.[5] ..... B65D 81/16
[52] U.S. Cl. ..... 206/320; 220/8
[58] Field of Search ..... 206/305, 320, 328, 334, 206/216, 591; 220/4.01, 4.21, 4.24, 8; 455/92

[56] References Cited

U.S. PATENT DOCUMENTS

| | | | |
|---|---|---|---|
| 1,664,465 | 4/1928 | Purchas | 220/8 |
| 1,750,576 | 3/1930 | Cubberley | 220/8 |
| 2,732,091 | 1/1956 | Kass | 220/8 |
| 2,907,487 | 10/1959 | Harrington | 220/8 |
| 3,463,343 | 8/1969 | Asenbauer | 220/8 |
| 4,573,573 | 3/1986 | Favaro | 206/216 |
| 4,733,776 | 3/1988 | Ward | 206/305 |
| 4,824,059 | 4/1989 | Butler | 206/591 |
| 5,175,876 | 12/1992 | Villacis Mendoza | 206/328 |

FOREIGN PATENT DOCUMENTS

| | | | |
|---|---|---|---|
| 0922674 | 6/1947 | France | 220/8 |
| 2088334 | 6/1982 | United Kingdom | 206/592 |

*Primary Examiner*—Jimmy G. Foster
*Attorney, Agent, or Firm*—Juettner Pyle Lloyd & Piontek

[57] ABSTRACT

This protection case (51) is adapted to fit remote controls having different size. To that aim, it comprises at least two opposite shells (52, 53) made of a shockproof material and being adjustable in position to suit the remote control dimensions.

30 Claims, 9 Drawing Sheets

XVI
XVI
71
60b
59
65
58
80
76
77
60a
73
73a
73b
75
83
75a
74

PROTECTION CASE FOR REMOTE CONTROLS

DESCRIPTION

1. Field of the Invention

This invention relates to a protection case for remote controls such as remote controls for TV set, video recorder, Hi-Fi set and the like.

2. Background art

As is known, these control units are often too fragile and vulnerable in normal household use; in fact, should it be dropped incidentally, a remote control may suffer sufficiently serious damage to put it out of operation.

To prevent such incidents, protection cases have been provided which are made of a shockproof material, usually rubber or the like; these cases are designed to be fit around the remote control, leaving the keyboard and signal emission areas thereof exposed (with the latter area frequently forming the remote control insertion opening as well). An example thereof is given by DE-U-8800772.

While such cases do meet the basic requirements of providing protection for the remote control, it is recognized that the very large variations which exist in the dimensions of remote controls force the cases to be manufactured in a correspondingly large variety to specifically fit one or at most a few similar remote controls each.

This entails disadvantages for the manufacturer, who is obliged to provide a range of different models in limited quantities, for the seller, who is obliged to keep extra large supplies of them, and for the user, who has always difficulties in choosing.

It actually happens that each point of sale only stocks the most popular models of protection cases, thus compelling the owner of a less common remote control to either waste his time to call (often unsuccessfully) at several different shops or give up buying a case. In addition, it has been found that, as a rule, large stores or self-service shops do not offer such cases at all, because even a minimum stock would occupy display space in amounts out of proportion to the product value and commercial worth.

DISCLOSURE OF THE INVENTION

To overcome such problems, this invention provides a protection case for a remote control, which is characterized in that it comprises two opposite shells made of a shockproof material, a first guide means for so positioning the two shells with respect to each other as to enclose the remote control in a first direction, and a first means of holding the shells in the selected position.

This protection case will fit remote control designs which differ from one another by one of their three basic dimensions; specifically, where the aforesaid first direction is the width direction, a single case can fit any remote controls having the same length and thickness. However, it will be at once apparent that the range of application of this case is much broader than that, it being evidently adaptable to also fit remote controls with different length and thickness, on condition that these do not exceed given maximum values corresponding to the case dimensions.

For enhanced adaptability, each of the shells comprises two opposite half-shells, a second guide means for so positioning the half-shells relatively to each other as to enclose the remote control in a second direction perpendicular to the first direction, and a second means of holding the half-shells in the selected position.

Thus, adjustability along two perpendicular directions is provided, and hence, true adaptability to remote controls differing one another in two of their basic dimensions; in particular, where the first direction is the width direction and the second is the length direction, then a single case can fit any remote controls having the same thickness. Here as well, the actual applicability of the case is even more enhanced, since only few remote controls are likely to have such thickness dimensions not to be protected thereby.

For even greater adaptability, anyhow, each half-shell includes a bottom and a cap located oppositely with respect to each other, a third guide means for so positioning the bottom and cap relatively to each other as to enclose the remote control along a third direction perpendicular to the first and second directions, and a third means of holding the bottom and cap in the selected position.

In the latter instance, it can be appreciated that only a remote control of most unusual design, significantly departing from a parallelepipedic shape, could present difficulty of adaptation.

The guide means and holding means may be a variety of types.

According to a first preferred embodiment, the first guide means comprises plates engaged for sliding movement in respective seats formed in the shells; the second guide means comprises at least one bar engaged for sliding movement in respective seats formed in the half-shells; the third guide means comprises upper and lower portions of the bar mounted for relative sliding movement.

According to a second, more preferred embodiment, the first guide means comprises plates and bars engaged for sliding movement in respective seats formed in the shells; the second guide means comprises bars engaged for sliding movement in respective seats formed in the half-shells; the third guide means comprises telescopic pillars connecting said bars of the first and second guide means.

Basically, the holding means, intended to prevent the remote control from slipping out of the case once fitted therein, consists in friction between sliding parts. Of preference, in case a stronger holding action is required, such means comprises ribs formed on the parts in mutual sliding contact, for improved frictional engagement.

Advantageously, some parts of the protection case, i.e. the first, second and third guide means, are made of a phosphorescent material. Thus, the important advantage is secured of making the remote control easy to find, at least by night; to that aim, it will be sufficient that the lighting be turned off momentarily to have the phosphorescent material visible at once.

Further features and advantages of a case according to the invention will become more clearly apparent from the following detailed description of two preferred embodiments thereof, to be read in conjunction with the accompanying drawings.

MODES FOR CARRYING OUT THE INVENTION

Figure 1:
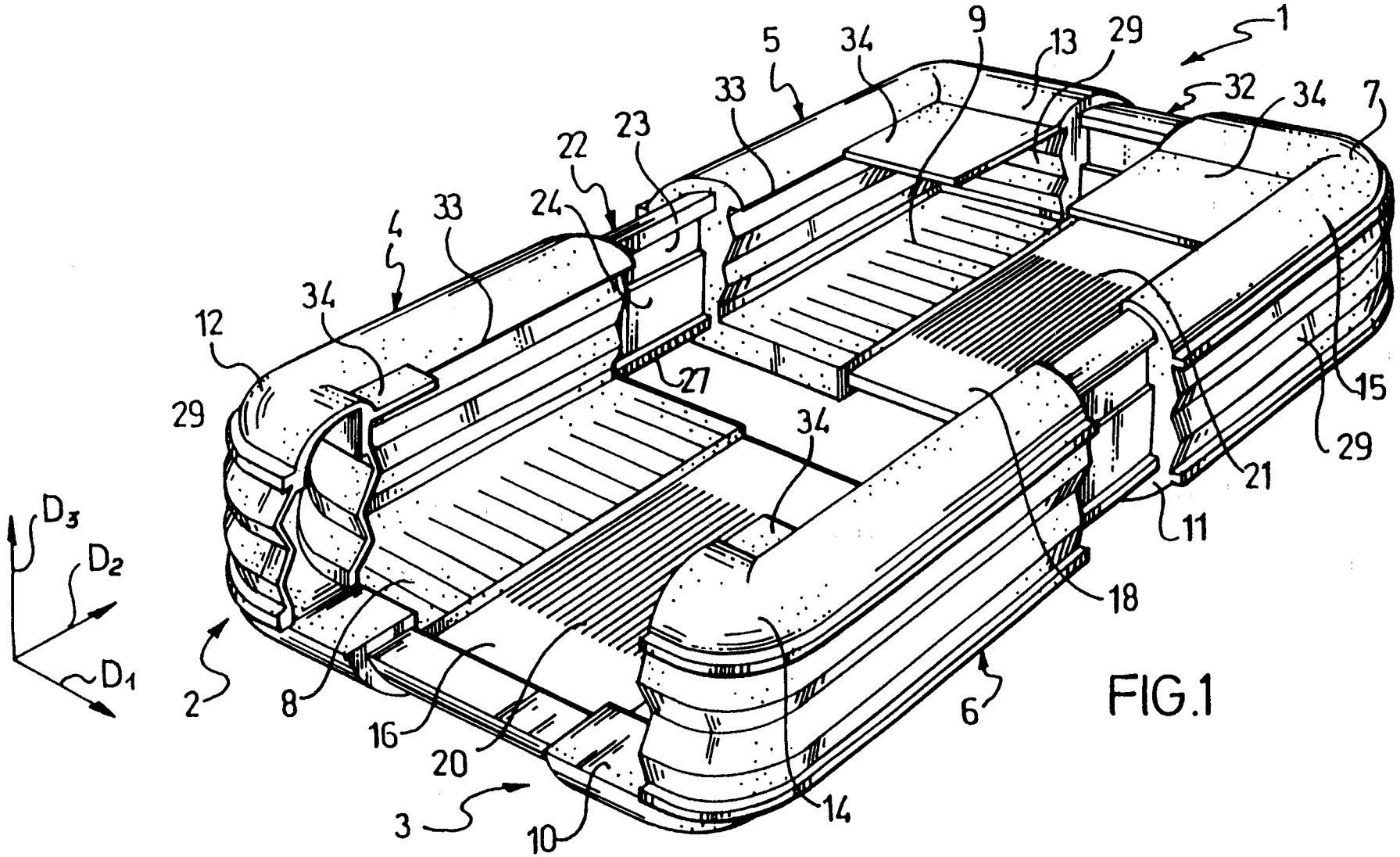
FIG. 1 is a perspective view of a first embodiment of protection case according to the invention.
Figure 2:
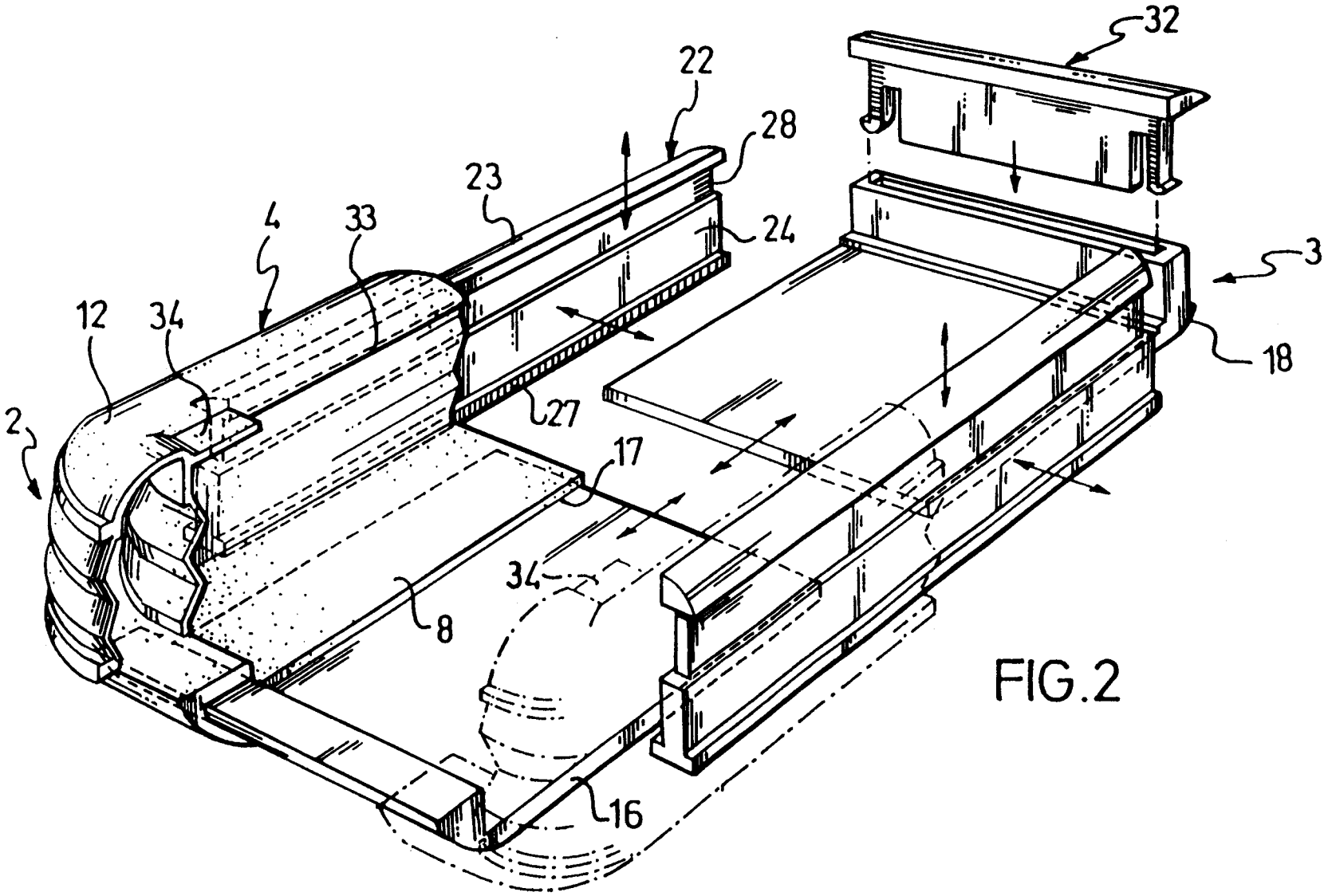
FIG. 2 is a part-sectional exploded view of the protection case shown in FIG. 1.
Figure 3:
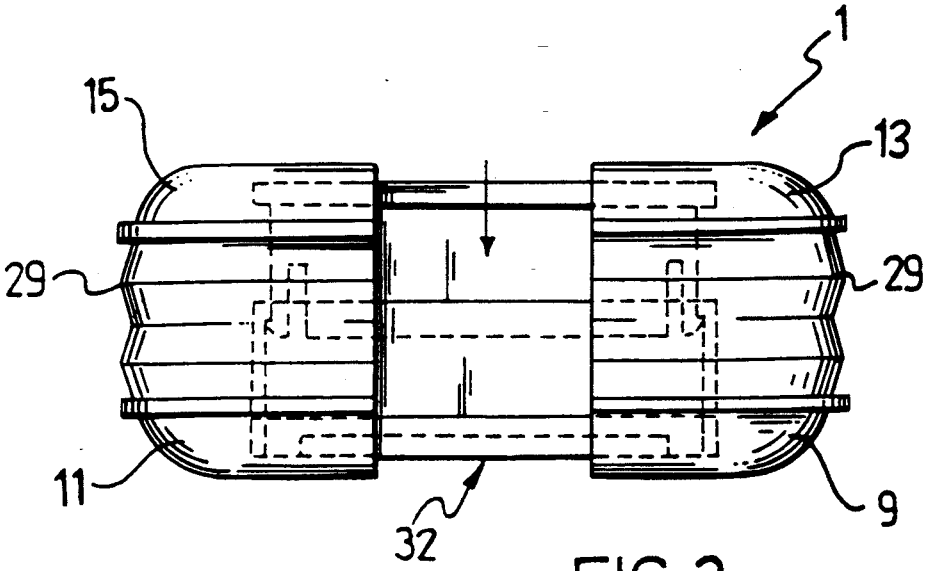
FIGS. 3 and 4 are side views of the protection case in FIG. 1, shown in two different positions of use.
Figure 4:
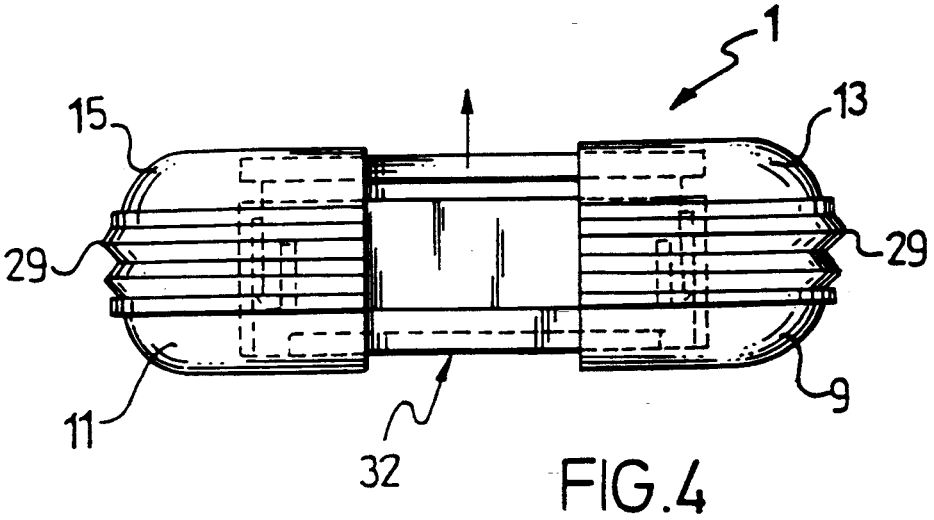

According to a first embodiment of the invention, a protection case is shown generally at 1 in the FIGS. 1 to 5; it is intended for protecting a remote control (not shown for clarity of illustration) having any dimensions.

The case 1 comprises two oppositely located shells, 2 and 3, which are formed from a shockproof material such as polyurethane, PVC, rubber, or the like, each shell being in turn comprised of two oppositely located halves 4, 5 and 6, 7, respectively; in addition, each half-shell includes a bottom 8, 9, 10, 11 and a cap 12, 13, 14, 15.

This protection case 1 further comprises a first guide means for positioning the two shells, 2 and 3, relatively to each other such that the remote control is enclosed along a first direction D1. Said first guide means comprises a first plate 16 engaging for sliding movement in seats 17 formed in the bottoms 8, 10 of the half-shells 4, 6, and a second plate 18 which engages for sliding movement in seats 19 formed in the bottoms 9, 11 of the half-shells 5, 7.

The case 1 also comprises a first means of holding the shells 2 and 3 in the selected position. This first holding means comprises plural knurled formations 20 and 21 on the plates 16 and 18 for enhanced frictional resistance to sliding movement along their respective seats, 17 and 19. Knurled formations may be likewise provided in the seats 17 and 19, additionally to or instead of knurled formations 20 and 21.

The shells 2 and 3 comprise each a second guide means for positioning the two half-shells 4, 5 and 6, 7 relatively to each other so as to enclose the remote control along a second direction D2, as well as a second means of holding the half-shells at the selected positions. These means are identical and arranged in symmetrical correspondence in the shell 2 and the shell 3 for concurrent operation; accordingly, for brevity of description and simplicity of illustration, only the means on shell 2 will be described hereinafter and referenced in the drawings.

The second guide means on shell 2 comprises a bar 22 having an upper portion 23 and a lower portion 24, both mounted for relative sliding movement along direction D3; the bar 22 by itself is slidable along seats in the half-shells 4 and 5 to provide for displacement along direction D2. More specifically, the upper portion 23 and lower portion 24 fit in respective seats 25 and 26 formed in the cap 12, 13 and the bottom 8, 9.

The second holding means on shell 2 comprises knurled formations 27 on the bar 22 effective to increase the frictional resistance to sliding movement along the seats 25 and 26; knurled formations may likewise be provided on the seats 25 and 26, additionally to or instead of knurled formations 27.

Each half-shell 4, 5, 6, 7 includes a third guide means and third holding means for the relative positioning of the bottoms 8, 9, 10, 11 and the caps 12, 13, 14, 15 so as to enclose the remote control along direction D3 and hold them in the selected position.

The third guide means comprises the above-mentioned portions 23 and 24 of bar 22, slidable along direction D3. The third holding means comprises knurled formations 28 on the upper portion 23 for increasing the frictional resistance to sliding movement relatively to portion 24; likewise, knurled formations may be provided on the lower portion 24 additionally to or instead of the knurled formations on the upper portion 23.

Bellows-shaped deformable portions, all indicated at 29, connect the bottoms 8, 9, 10, 11 to their respective caps 12, 13, 14, 15, partly cover bar 22 and allow movement of portions 23 with the caps 12, 13, 14, 15 relatively to portion 24 with the bottoms 8, 9, 10, 11.

To improve retaining of the remote control, caps 12, 13, 14, 15 comprise four respective rims, all indicated at 33, made solid with bellow portions 29. Rims 33 project inwardly, one toward the others, and thus positively cooperate with bottoms 8, 9, 10, 11 in retaining the remote control. Preferably, in the corner regions of the case 1 the rims 33 enlarge, forming flaps 34.

Figure 5:
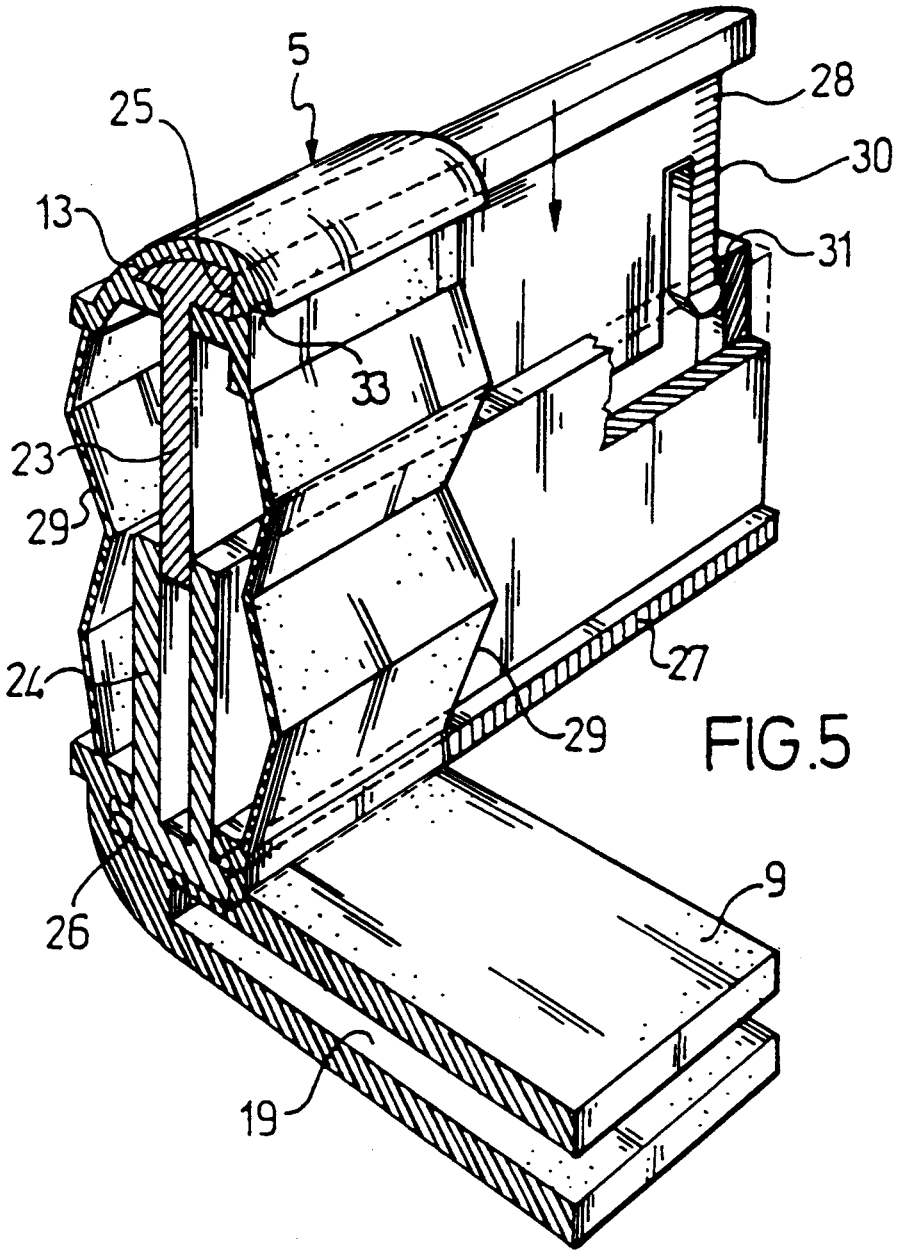
FIG. 5 is a sectional view of a detail of the case shown in FIG. 1.
Figure 6:
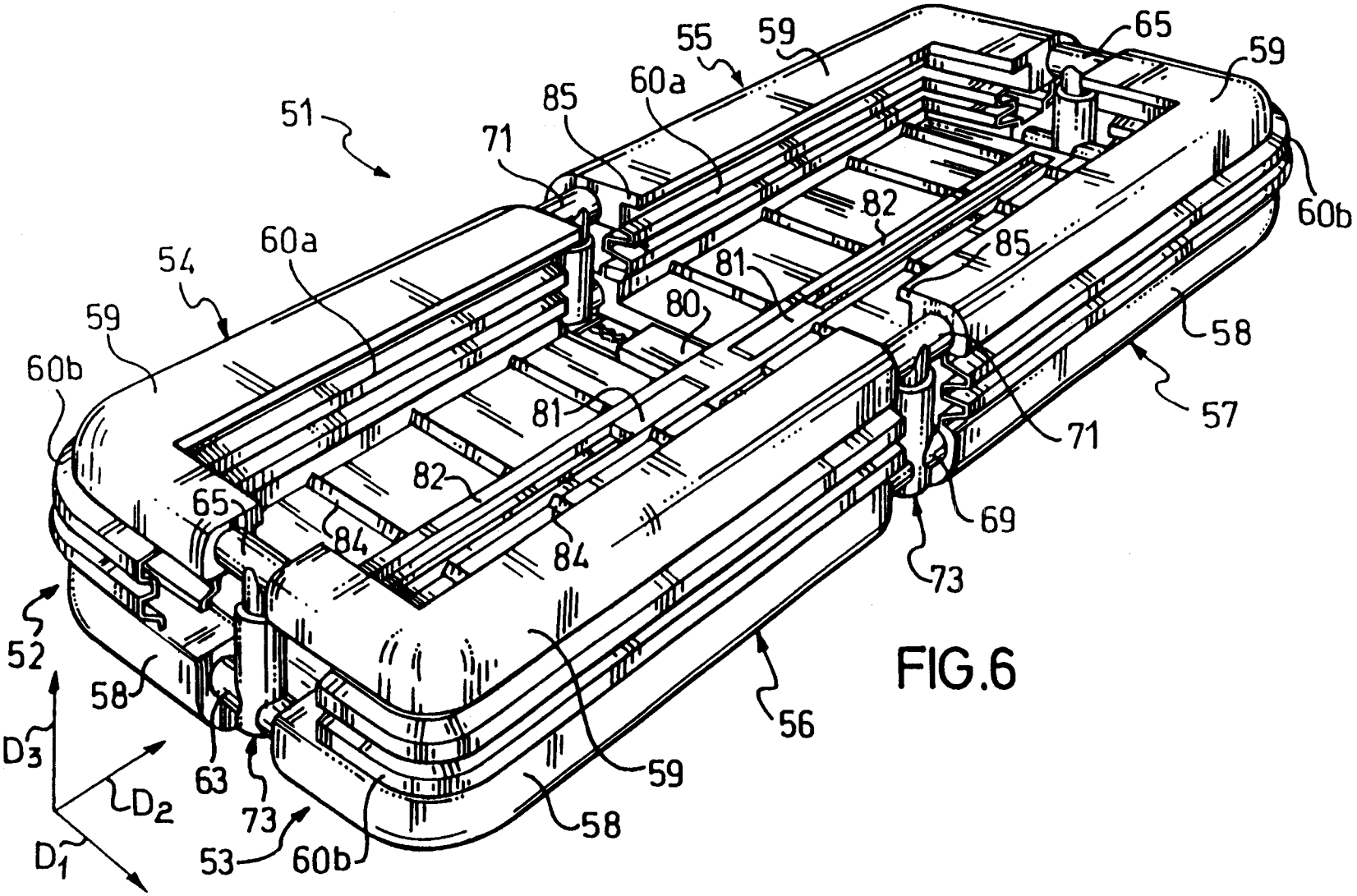
FIG. 6 is a perspective view of a further embodiment of protection case according to the invention.
Figure 7:
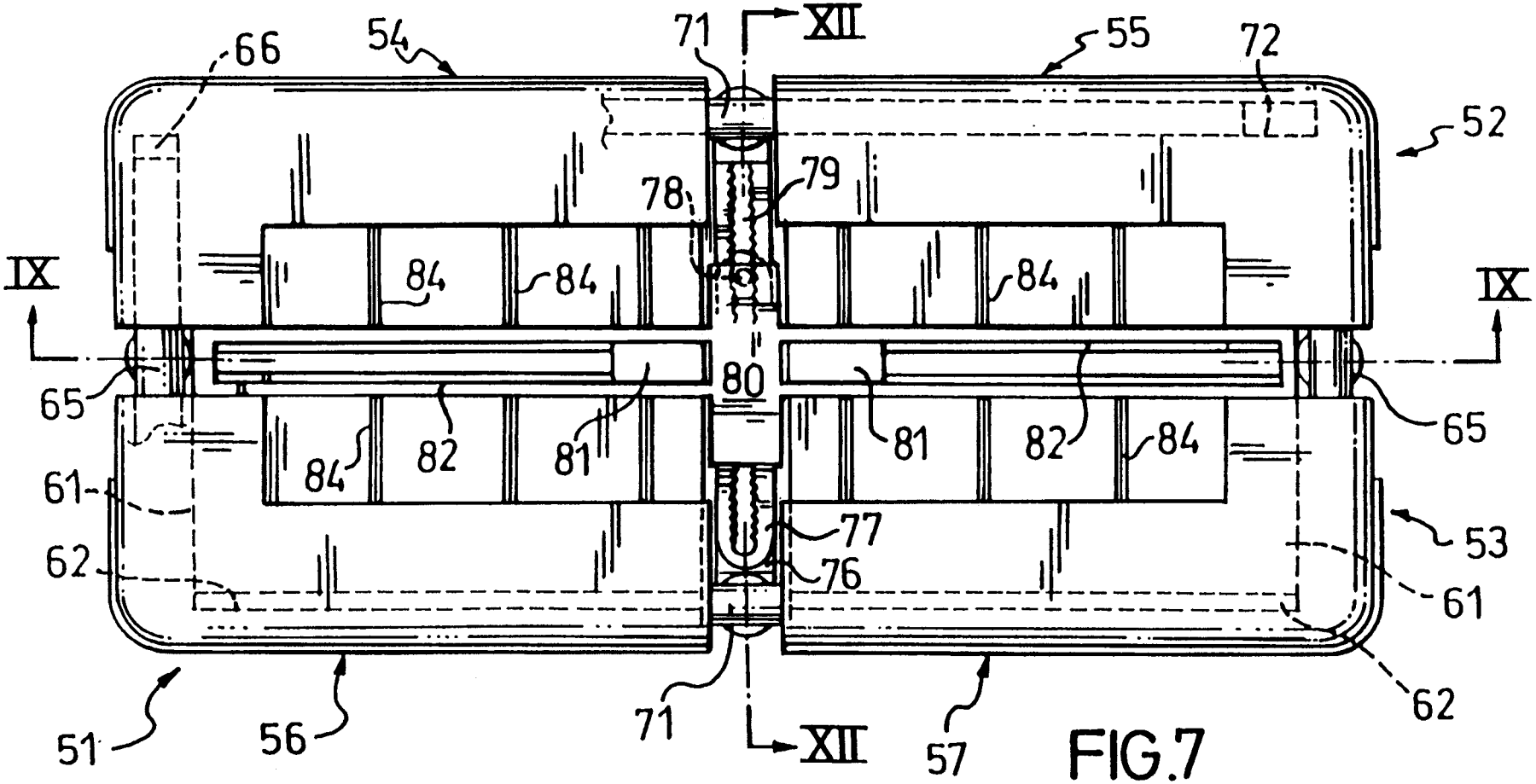
FIGS. 7 and 8 are top and bottom plan view of the protection case shown in FIG. 6.
Figure 15:
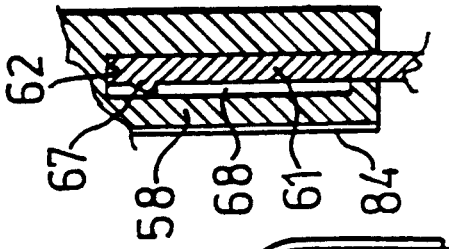
FIGS. 15 and 16 are section views of details of the protection case of FIG. 6.
Figure 8:
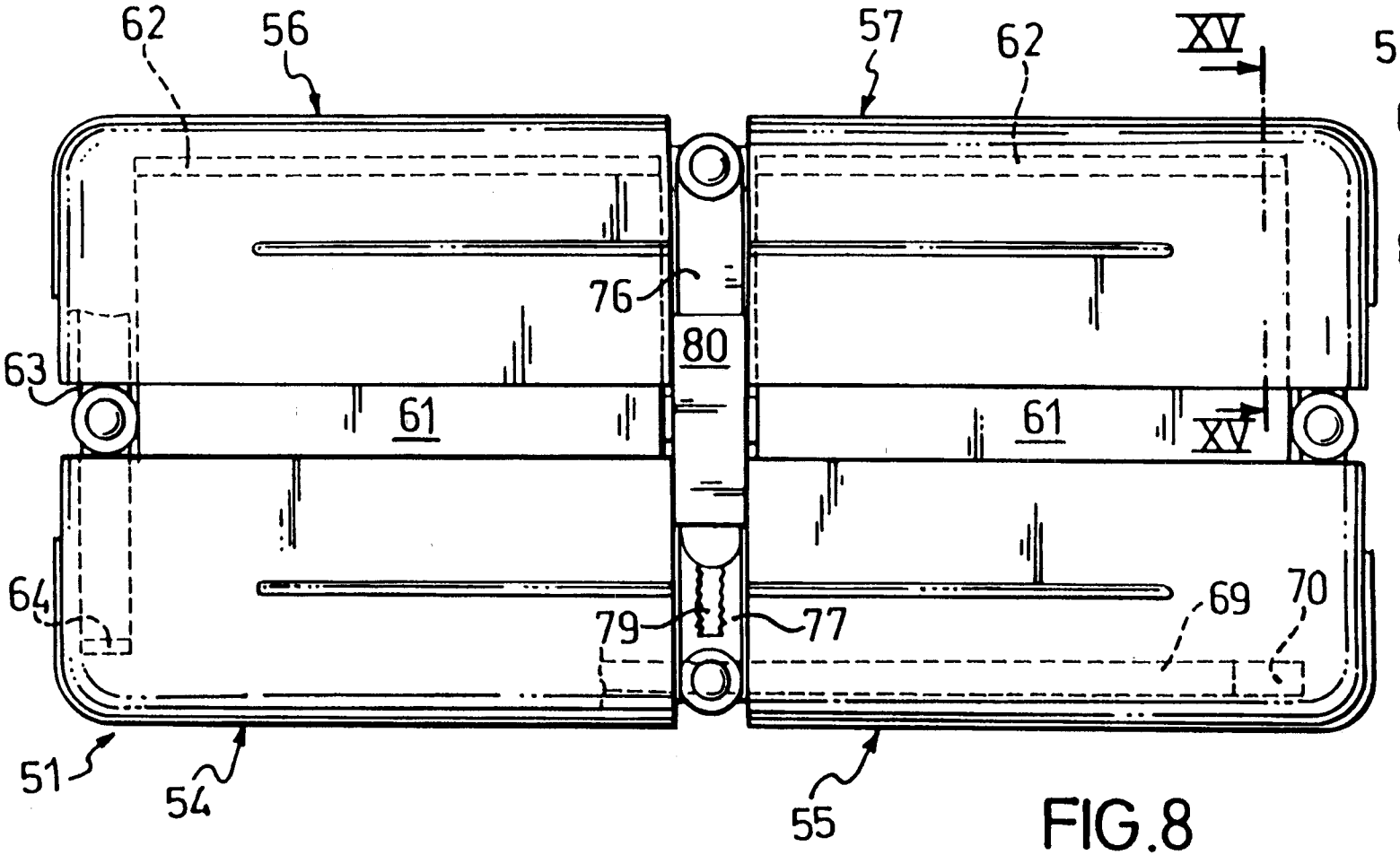
Figures 9, 10, 11:
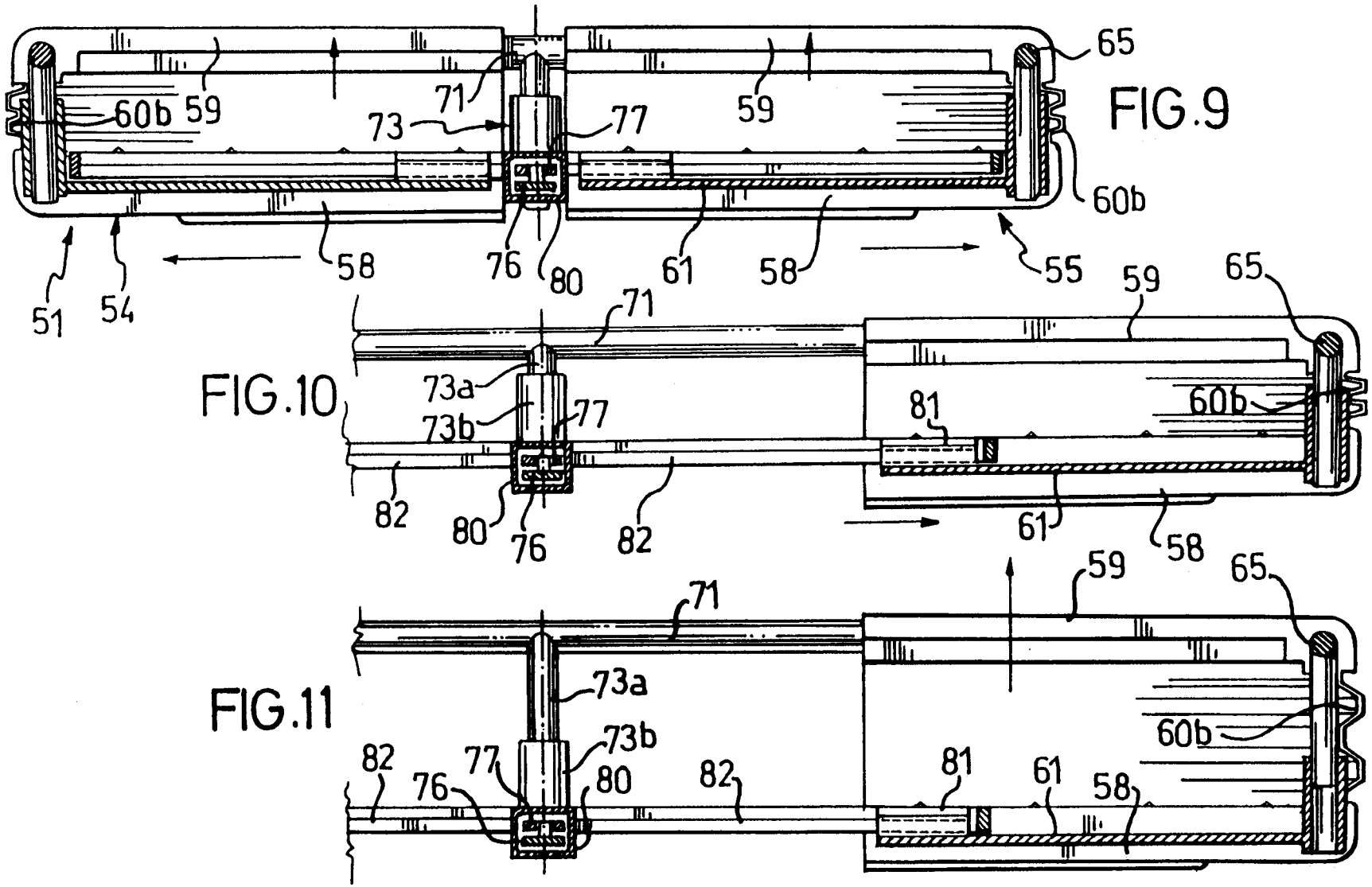
FIGS. 9, 10 and 11 are side sectional views of the protection case shown in FIG. 6, in different positions of use.
Figures 12, 13, 14, 16:
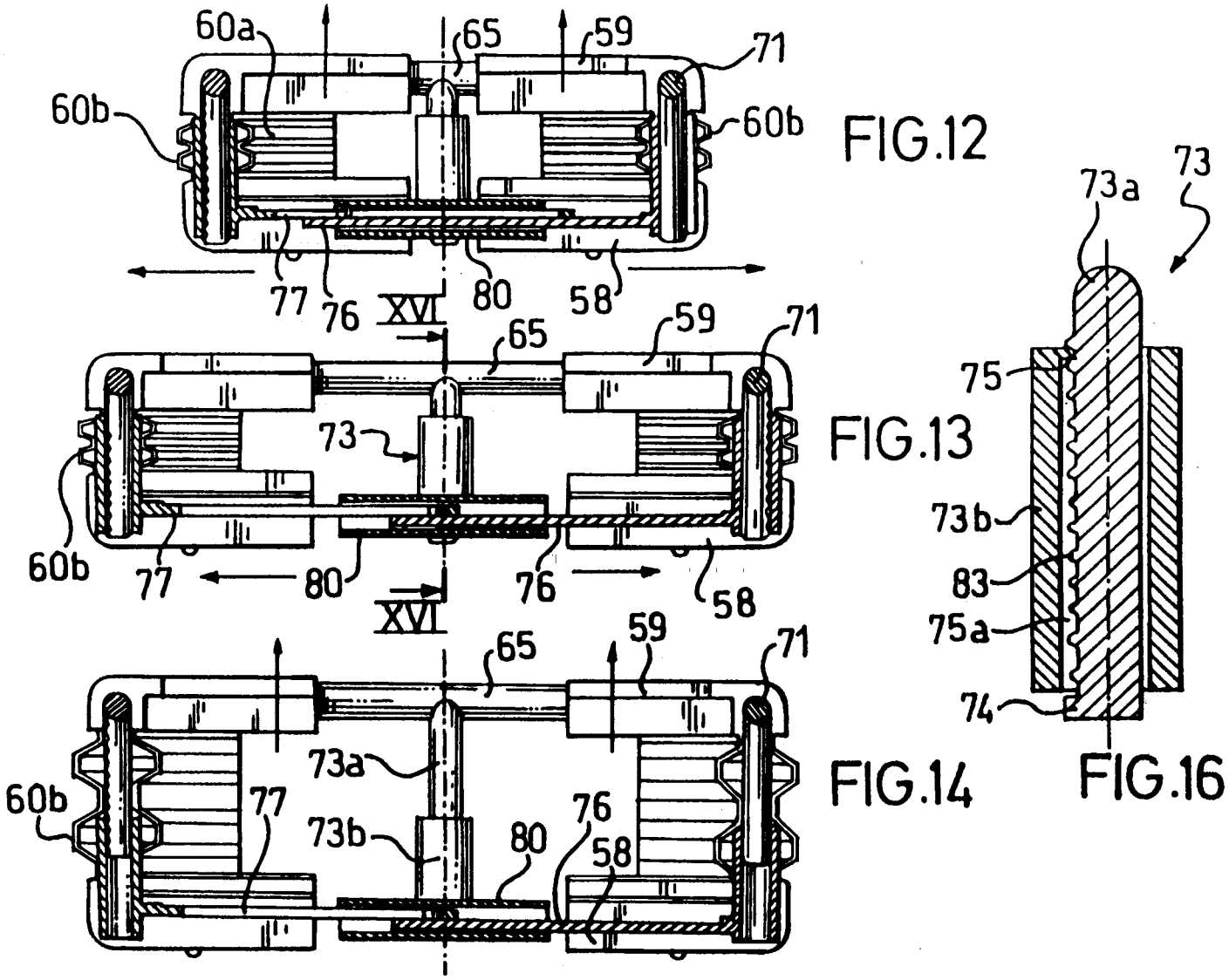
FIGS. 12, 13 and 14 are front sectional views of the protection case shown in FIG. 6, in different positions of use.

All the mutually moving parts, namely plates 16 and 18 to the half-shells 4, 6 and 5, 7, bars 22 to the half-shells 4, 6 and 5, 7, upper portions 23 to the lower portions 24, are provided with means preventing incidental separation of parts. Of such means, basically comprising elastic elements adapted to engage in suitable undercuts, there are shown in FIG. 5 an elastically deformable hooked element 30 which is formed integrally with the upper portion 23 of bar 22, and an undercut or mating hook 31 formed integral with the lower portion 23 of said bar 22. Similar arrangements, not shown, are provided for the remainder of the aforesaid mated connections.

Since one side of the remote control should be left preferably exposed not to interfere with the signal transmission, though the opposite side therefrom need not, plate 18 has an upward extension, generally shown at 32, on one end, which duplicates the construction of the bar 22, with the lower portion fast with plate 18.

Advantageously, the various guide means (16, 18, 22, 32) would be made of a phosphorescent material. In this way, the important advantage is afforded of making the remote control readily retrievable, at least by night, on momentarily turning off the lighting.

The operation of this protection case 1 will be now described briefly, although readily inferable from the foregoing description.

Before a remote control to be protected is slipped in, the case 1 is open along all directions D1, D2 and D3 to a sufficient extent by moving the four half-shells 4, 5, 6, 7 away from one another, and the bottoms 8, 9, 10, 11 from the caps 12, 13, 14, 15. This operation will require application of some force to overcome the friction drag from the various knurled formations.

Thereafter, the reverse-order operation is carried out, still against frictional drag, to lower the caps toward their respective bottoms down to the requisite height for protecting the remote control, and bring the half-shells 4, 5, 6, 7 closer together; ultimately, the remote control will be clamped between the half-shells to a protected condition from shocks and incidental dropping.

According to a second embodiment of the invention, a protection case 51 is shown in FIGS. 6 to 16.

The case 51 comprises two opposite located shells, 52 and 53, which are formed of a shockproof material such as polyurethane, PVC, rubber or the like; each shell is in turn comprised of two opposite located halves 54, 55 and 56, 57, respectively; in addition, each half-shell includes a bottom 58 and a cap 59.

The bottom 58 and the cap 59 of each half-shell are made solid with respective extendable inner bellow shaped portions 60*a* and outer bellow shaped portions 60*b*.

The protection case 51 further comprises a first guide means for positioning the two shells 52, 53, relatively to each other such that the remote control is enclosed along a first direction D1. Said first guide means comprises two plates 61 engaging for sliding movement in seats 62 formed in the bottoms 58 of the half-shells. Additionally, two lower bars 63 are provided, which are solid to a respective one of the plates 61 and engage for sliding movement in seats 64 formed in the bottoms 58, adjacent to the seats 62; other two upper bars 65 engage for sliding movement in seats 66 formed in the caps 59.

Hooks 67 formed on the plates 61 engage with respective recesses 68 formed in the seats 62, to avoid unintended separation of the shells 52, 53.

The protection case 51 further comprises a second guide means for positioning the half-shells 54, 55, 56 and 57 of the two shells 52, 53 relatively to each other such that the remote control is enclosed along a second direction D2. Said second guide means comprises two lower bars 69, which engage for sliding movement in seats 70 formed in the bottoms 58, and other two upper bars 71, which engage for sliding movement in seats 72 formed in the caps 59.

The protection case 51 further comprises a third guide means for positioning the caps 59 and the bottoms 58 relatively to each other such that the remote control is enclosed along a third direction D3. Said third guide means comprises four telescopic pillars 73, each connecting a lower bar 63 with an upper bar 65 or a lower bar 69 with an upper bar 71, in the middle thereof; each pillar 73 has a male portion 73*a* solid to one of the upper bars 65 or 71 and a female portion 73*b* solid to one of the lower bars 63 or 69.

Pillars 73 are provided with means for avoiding unintended separations of the caps 59 and the bottoms 58; such means comprises a tooth 74 laterally formed on the male portion 73*a* and a respective recess 75 formed in the female portion 73*b*. To make assembling easier, each pillar 73 has a circular section, with a groove 75*a* formed along the whole female portion 73*b* in a position opposite to the recess 75; upon insertion of the male into the female portion, the tooth 74 is inserted into the groove 75*a*, and then the male portion 73*a* is turned by 180° to ensure engagement of the tooth 74 and the recess 75.

Means for holding the parts in the desired position are provided in the protection case 1.

Along the first direction D1, first holding means comprises two superimposed strips 76 and 77, each made solid with one of the lower bars 69 in the middle thereof; strip 76 is provided with a pin 78 which engages in a knurled slot 79 formed in the strip 77. Both strips 76 and 77 slide in a same loop body 80, which ensures constant engagement of the pin 78 in the slot 79. Besides, the two strips 76, 77 cooperate with the hooks 67 and recesses 68 in avoiding unintended separation of parts in the first direction D1.

Along the second direction D2, second holding means comprises two protrusions 81 formed on the plates 61, in sliding engagement in two respective closed rails 82, which are made solid with the loop body 80 and extend in the second direction D2. The width of the protrusions 81 is a little larger than the width of the rails 82, so that a significant friction provides the necessary holding action. Besides, protrusions 81 and rails 82 act as means for avoiding unintended separation of parts in the second directions D2.

Along the third direction D3, third holding means comprises ribs 83 formed on an external surface of the male portion 73*a* of the telescopic pillars 73. Such ribs 83 cooperate with the edge of the recess 75 to ensure the necessary holding action.

To give a better protection to the remote control, the upper face of the bottoms 58, on which the remote control rests, is provided with small deformable protrusions 84. Besides, caps 59 comprise respective rims 85, which project inwardly, one toward the others, and thus positively cooperate with bottoms 58 in retaining the remote control.

The operation of protection case 51 is substantially identical to that of case 1. Only, it is to be remarked the retaining action in all the three directions D1, D2 and D3, provided respectively by the hooks 67 in recesses 68 and pin 78 in slot 79 (direction D1), by protrusions 81 in closed rails 82 (direction D2), by teeth 74 in recesses 75 (direction D3).

Besides, it is to be noted also that the substantially more open structure provided by the bars 63, 65, 69, 71 (with respect to the bars 22 and the upward extension 32 of the case 1) makes useless the provision for an open or exposed side to allow signal transmission. This gives more firmness to the case 51, and hence more protection to the remote control.

Finally, it is to be noted that simplified versions (not shown) of cases 1 or 51 may have some of the adaptation features omitted. For example, the shells could be unitary constructions instead of being split into two halves, the two plates being replaced with a single plate, thereby leaving the adaptation ability along direction D2; or the half-shells could be single pieces, instead of being split into bottoms and caps, thereby leaving adjustability along direction D3. Likewise, although adjustment along direction D1 appears of major practical importance, the adjacent half-shells could be one-piece constructions and this adjustment done without.

I claim:

1. A protection case (1; 51) for a remote control, comprising:

two opposite shells (2, 3; 52, 53) made of a shockproof material, a first guide means (16, 17, 18, 19; 61, 62, 63, 64, 65, 66) for so positioning the two shells (2, 3; 52, 53) with respect to each other as to enclose the remote control in a first direction (D1), a first means (20, 21; 76, 77, 78, 79) of holding the shells (2, 3; 52, 53) in the selected position in the first direction (D1), wherein each shell (2, 3; 52, 53) comprises:

two opposite half-shells (4, 5, 6, 7; 54, 55, 56, 57), a second guide means (22, 25, 26; 69, 70, 71, 72) for so positioning the half-shells (4, 5, 6, 7: 54, 55, 56, 57) relatively to each other as to enclose the remote control in a second direction (D2) perpendicular to the first direction (D1), a second means (27; 81, 82) of holding the half-shells (4, 5, 6, 7; 54, 55, 56, 57) in the selected position in the second direction D2), wherein each half-shell comprises:

a bottom (8, 9, 10, 11; 58) and a cap (12, 13, 14, 15; 59) located opposite to each other, a third guide means (23, 24; 73) for so positioning the bottom (8, 9, 10, 11; 58) and cap (12, 13, 14, 15; 59) relatively to each other as to enclose the remote control in the third direction (D3) perpendicular to the first (D1) and second (D2) directions.

a third means (23; 83) of holding the bottom (8, 9, 10, 11; 58) and the cap (12, 13, 14, 15; 59) in the selected position in the third direction (D3), wherein the first guide means comprises at least two plates (16, 18; 61) engaged for sliding movement in respective seats (17, 19; 62) formed in the bottoms (8, 9, 10, 11; 58), below the position intended for the remote control to be protected.

2. A protection case (1; 51) according to claim 1, wherein the second guide means comprise at least one bar (22; 69, 71) engaged for sliding movement in respective seats (25, 25: 70 72) formed in the half-shells (4, 5, 6, 7: 54, 55, 56, 57).

3. A protection case (1) according to claim 2, wherein the second guide means comprises bars (22) engaged for sliding movement in respective seats (25, 26) formed in the half-shells (4, 5, 6, 7) and the third guide means comprises upper (23) and lower (24) portions of the bar (22) mounted for sliding movement relatively to each other.

4. A protection case (1) according to claim 3, wherein the third holding means comprises plural knurled formations (28) on the lower (24) and/or upper (23) portions of the bar (22) for increased mutual friction drag.

5. A protection case (1) according to claim 2, wherein the second holding means comprises plural knurled formations (27) on the bar (22) and/or the respective seats (25, 26) in the half-shells (4, 5, 6, 7) for increased mutual friction drag.

6. A protection case (1) according to claim 1, wherein the first holding means comprises plural knurled formations (20, 21) on the plate (16, 18) and/or the respective seats (17, 19) in the shells (2, 3) for increased mutual friction drag.

7. A protection case (51) according to claim 1, wherein the first holding means comprises two superimposed strips (76, 77), each secured to a respective one of the shells (52, 53) and both being slidingly engaged in a loop body (80), one strip (77) being provided with a knurled slot (79), the other strip (76) being provided with a pin (78) engaged in the slot (79).

8. A protection case (51) according to claim 1, wherein the first guide means comprises two plates (61) engaged for sliding movement in two respective seats (62) formed in the half-shells (54, 55, 56, 57), and the second holding means comprises two protrusions (81) formed on the plates (61), in sliding engagement in two respective closed rails (82), the rails extending along the second direction (D2), the width of the protrusions (81) being a little larger than the width of the closed rails (82).

9. Protection case according to claim 1, wherein the first and the second guide means comprise lower bars (63, 69) engaged for sliding movement in respective seats (64, 70) formed in the bottoms (58) and upper bars (65, 71) engaged for sliding movement in respective seats (66, 72) of the caps (59), and the third guide means comprises telescopic pillars (73) connecting said lower bars to said upper bars.

10. A protection case (1; 51) according to claim 1, wherein the protection case comprises parts made of a phosphorescent material.

11. A protection case (1; 51) according to claim 1, wherein each cap (12, 13, 14, 15; 59) is provided with an inwardly projecting rim (33; 85).

12. A protection case (1) according to claim 11, wherein each rim (33) is enlarged in the corner regions of the case (1), forming a flap (34).

13. A protection case (1; 51) according to claim 1, wherein the bottom (8, 9, 10, 11; 58) and the cap (12, 13, 14, 15; 59) of each half-shell (4, 5, 6, 7; 54, 55, 56, 57) are integral with bellow shaped connection portions (29; 60*a*, 60*b*), extendable in the third direction (D3).

14. A combination of a protection case (1; 51) and a remote control, wherein the protection case comprises two opposite shells (2, 3; 52, 53) made of a shockproof material, a first guide means (16, 17, 18, 19; 61, 62, 63, 64, 65, 66) for so positioning the two shells (2, 3; 52, 53) with respect to each other as to enclose the remote control in a first direction (D1), and a first means (20, 21; 76, 77, 78, 79) of holding the shells (2, 3; 52, 53) in the selected position.

15. A combination according to claim 14, wherein each of the shells (2, 3; 52, 53) comprises two opposite half-shells (4, 5, 6, 7; 54, 55, 56, 57), a second guide means (22, 25, 26; 69, 70, 71, 72) for so positioning the half-shells (4, 5, 6, 7; 54, 55, 56, 57) relatively to each other as to enclose the remote control in a second direction (D2) perpendicular to the first direction (D1), and a second means (27; 81, 82) of holding the half-shells (4, 5, 6, 7; 54, 55, 56, 57) in the selected position.

16. A combination according to claim 15, wherein each half-shell comprises a bottom (8, 9, 10, 11; 58) and a cap (12, 13, 14, 15; 59) located opposite to each other, a third guide means (23, 24; 73) for so positioning the bottom (8, 9, 10, 11; 58) and cap (12, 13, 14, 15; 59) relatively to each other as to enclose the remote control in a third direction (D3) perpendicular to the first (D1) and second D2) directions, and a third means (28; 83) of holding the bottom (8, 9, 10, 11; 58) and cap (12, 13, 14, 15; 59) in the selected position.

17. A combination according to claim 16, wherein the second guide means comprises at least one bar (22; 69, 71) engaged for sliding movement in respective seats (25, 26; 70, 72) formed in the half-shells (4, 5, 6, 7; 54, 55, 56, 57).

18. A protection case (1) according to claim 17, wherein the second guide means comprises bars (22 engaged for sliding movement in respective seats (25, 26) formed in the half-shells (4, 5, 6, 7) and the third guide means comprises upper (23) and lower (24) portions of the bar (22) mounted for sliding movement relatively to each other.

19. A protection case (1) according to claim 18, wherein the third holding means comprises plural knurled formations (28) on the lower (24) and/or upper (23) portions of the bar (22) for increased mutual friction drag.

20. A protection case (1) according to claim 17, wherein the second holding means comprises plural knurled formations (27) on the bar (22) and/or the respective seats (25, 26) in the half-shells (4, 5, 6, 7) for increased mutual friction drag.

21. Protection case according to claim 16, wherein the first and the second guide means comprise lower bars (63, 69) engaged for sliding movement in respective seats (64, 70) formed in the bottoms (58) and upper bars (65, 71) engaged for sliding movement in respective seats (66, 72) of the caps (59), and the third guide means comprises telescopic pillars (73) connecting said lower bars to said upper bars.

22. A combination according to claim 16, wherein each cap (12, 13, 14, 15; 59) is provided with an inwardly projection rim (33; 85).

23. A protection case (1) according to claim 33, wherein each rim (33) is enlarged in the corner regions of the case (1), forming a flap (34).

24. A combination according to claim 16, wherein the bottom (8, 9, 10, 11; 58) and the cap (12, 13, 14, 15; 59) of each half-shell (4, 5, 6, 7; 54, 55, 56, 57) are integral with bellow shaped connection portions (29; 60*a*, 60*b*), extendable in the third direction (D3).

25. A protection case (51) according to claim 15, wherein the first guide means comprises two plates (61) engaged for sliding movement in two respective seats (62) formed in the half-shells (54, 55, 56, 57), and the second holding means comprises two protrusions (81) formed on the plates (61), in sliding engagement in two respective closed ails (82), the rails extending along the second directions (D2) and being formed in a same rod, the width of the protrusions (81) being a little larger than the width of the closed rails (82).

26. A combination according to claim 14, wherein the first guide means comprise at least one plate (16, 18; 61) engaged for sliding movement in respective seats (17, 19; 62) formed in the shells (2, 3; 52, 53).

27. A protection case (1) according to claim 26, wherein the first holding means comprises plural knurled formations (20, 21) on the plate (16, 18) and/or the respective seats (17, 19) in the shells (2, 3) for increased mutual friction drag.

28. A protection case (51) according to claim 26, wherein the first guide means further comprises bars (63, 65) engaged for sliding movement in respective seats (64, 66) formed in the shells (52, 53).

29. A protection case (51) according to claim 26, wherein the first holding means comprises two superimposed strips (76, 77), each secured to a respective one of the shells (52, 53) and both being slidingly engaged in a loop body (80), one strip (77) being provided with a knurled slot (79), the other strip (76) being provided with a pin (78) engaged in the slot (79).

30. A combination according to claim 14, wherein the protection case comprises parts made of a phosphorescent material.

* * * * *